United States Patent [19]

Fair et al.

[11] Patent Number: 4,515,665

[45] Date of Patent: May 7, 1985

[54] METHOD OF STABILIZING METAL-SILICA COMPLEXES IN ALKALI METAL HALIDE BRINES

[75] Inventors: David L. Fair, Chattanooga; David D. Justice, Cleveland; Pilar P. Kelly, Knoxville, all of Tenn.

[73] Assignee: Olin Corporation, Cheshire, Conn.

[21] Appl. No.: 544,677

[22] Filed: Oct. 24, 1983

[51] Int. Cl.[3] ..... C25B 1/46

[52] U.S. Cl. ..... 204/98; 204/128

[58] Field of Search ..... 204/98, 128

[56] References Cited

U.S. PATENT DOCUMENTS

| | | | |
|---|---|---|---|
| 3,793,163 | 2/1974 | Dotson | 204/128 |
| 3,948,737 | 4/1976 | Cook, Jr. et al. | 204/128 |
| 4,038,365 | 7/1977 | Patil et al. | 204/128 |
| 4,055,475 | 10/1977 | Dotson et al. | 204/98 |
| 4,115,218 | 9/1978 | Krumpelt | 204/128 |
| 4,118,308 | 10/1978 | Specht | 204/98 |
| 4,155,820 | 5/1979 | Ogawa et al. | 204/98 |
| 4,176,022 | 11/1979 | Darlington | 204/128 |
| 4,217,187 | 8/1980 | Tufts et al. | 204/128 |
| 4,230,544 | 10/1980 | McRae | 204/98 |
| 4,236,980 | 12/1980 | Medic et al. | 204/128 |
| 4,242,185 | 12/1980 | McRae | 204/98 |
| 4,274,929 | 6/1981 | Novak | 204/98 |

*Primary Examiner*—R. L. Andrews
*Assistant Examiner*—Terryence Chapman
*Attorney, Agent, or Firm*—James B. Haglind; Donald F. Clements

[57] ABSTRACT

A method for stabilizing metal-silica, particularly aluminum-silica colloidal complexes in an alkali metal halide, particularly sodium chloride, brine used as an anolyte feedstock for membrane electrolytic cells. Such stabilization is achieved by modifying the startup procedure of the cell so as to promote a sufficient level of hydroxyl ion backmigration during electrolysis so as to keep the pH of said brine at a value about 3.5.

12 Claims, No Drawings

METHOD OF STABILIZING METAL-SILICA COMPLEXES IN ALKALI METAL HALIDE BRINES

BACKGROUND OF THE INVENTION

This invention relates to a method for treating alkali metal halide, particularly sodium chloride, brines to stabilize metal-silica, particularly aluminum-silica colloidal complexes therein, when said treated brines are used as anolyte feedstock for a membrane electrolytic cell.

Typically, recirculating anolyte brines used in chlor-alkali electrolytic cells are, after dechlorination and resaturation, treated with chemicals such as sodium hydroxide, sodium carbonate and barium chloride to form an insoluble precipitate with the calcium, magnesium and sulfate ions introduced into the brine with the rock salt used for resaturation. Frequently, such a precipitate is finely divided so that the individual particles thereof tend to settle rather slowly. To avoid holding the brine for excessive periods of time before it can be used, a flocculating agent such as aluminum chloride may also be added. This, on contact with the alkaline brine, forms a gelatinous hydrated oxide which agglomerates the precipitate and quickly settles it for removal by filtration or purging from the now reconstituted anolyte brine.

Along with the aforesaid calcium and magnesium, rock salt also typically contains small amounts of silica and aluminum. In alkali metal chloride brines, the silica forms a hydrophobic colloidal sol which is readily peptized by the negative chlorine ions in the brine so as to be quite stable and difficult to coagulate. Where positive ions, such as aluminum or calcium, are also present, they are strongly attracted by the negatively charged colloid to form colloidal particles of a metal silica complex which are small in size, non-aggregatable and non-ionic. Thus, they are not readily removable either by filtration or ion exchange treatments, such as those used to produce "conventional" membrane cell quality brines. Such brines typically have not only a pH of between about 4 to about 12, a calcium content of between about 20 and about 60 ppb, and correspondingly low contents of iron, magnesium, sulfate, chlorate and carbonate ions, but also an aluminum content of between about 0.1 and about 2.5 ppm and a silica content of between about 0.1 and about 20 ppm.

During electrolysis of these brines, a certain amount of hydrochloric and hypochlorous acid forms in the brine. Even though some of this is neutralized by backmigrating hydroxyl ions coming from the catholyte compartment, not all of it is, so the anolyte pH decreases. In many cell systems using high performance membranes of a type which effectively suppress such backmigration, such as the carboxylate/sulfonate composite described in U.S. Pat. No. 4,202,743, issued May 13, 1980 to Oda et al., the pH of the anolyte solution frequently drops to a range of about 2 to about 3. However, at such a pH, it is found that many of these complexes dissociate with the metallic component reappearing in positive ionic form. In a membrane cell, these positive ions are transported, during electrolysis, into the membranes wherein on contact with the strongly basic catholyte solution, they tend to precipitate therein, plugging it and resulting in a permanent loss of membrane efficiency.

OBJECTS

It is an object of the present invention to provide a process for stabilizing metal-silica complexes in purified concentrated alkali metal halide brines.

It is a further object of the present invention to provide a process for stabilizing aluminum-silica complexes in purified concentrated sodium chloride brines.

It is still another object of the present invention to provide a process for electrolyzing said stabilized brine in a membrane cell so that said complexes do not dissociate therein and membrane performance is not degraded.

It is still another object of the present invention to provide a process for using said brine in said cell so as to prevent decomposition of said complexes therein.

These and other objects of the invention will become apparent from the following description and the appended claims.

BRIEF SUMMARY OF THE INVENTION

These and other objects are met by a process for stabilizing a complex of metal and silica in an alkali metal halide brine used as an anolyte feedstock in an electrolytic membrane cell having an anolyte compartment and a catholyte compartment, said process comprising (a) adjusting the pH of said brine to a level of between about 4 and about 12; and (b) passing said pH adjusted feedstock into said anolyte compartment while operating said cell under conditions which maintain the pH of said brine during electrolysis at a value above about 3.5.

DETAILED DESCRIPTION OF THE INVENTION

In the process of the present invention, stabilization of metal-silica, particularly aluminum-silica colloidal complexes in alkali metal halide, particularly sodium chloride, anolyte brines used in a membrane-type electrolytic cell, is accomplished by treating said brine so as to be at a pH of from about 4 to about 12 and preferably from about 8 to about 10, when it is provided to said cell and then operating said cell so as to keep the pH of the depleted brine above the dissociation value of said complex. Such a value depends both upon the nature of the metallic constituent in the complex and the chemical composition of the solution in which it occurs. For aluminum-silica complexes in sodium chloride brines, such dissociation occurs at a pH in the range from about 2.5 to about 3.5. Therefore, if the pH of the depleted brine is kept above about 3.5 and preferably above about 4.0, no dissociation will occur and the aforesaid deposition of aluminum and loss of membrane efficiency is prevented.

Such a final pH can be achieved in several ways. In a first of these, additional caustic may be added to the brine to bring it to a pH of between about 11 and about 12 so that the HCl and HOCl formed will be sufficiently neutralized to keep the pH above the desired value.

However, aluminum-silica complexes tend to decompose in strongly alkali media, i.e. a pH in excess of about 12, with both the silica and aluminum being dissolved. Since the normal pH of the brine, after ion exchange is between about 8 and about 10, and since the ion exchange resins used for final calcium and magnesium removal are usually not adapted to work well at such pH levels, the additional caustic must be added to the brine after such ion exchange, usually at the head tank manifold for the cell. In so doing, care must be used to prevent the discharged anolyte brine from reaching a pH much in excess of 6. At this level, at least some of the hydroxyl ions will be discharged at the anode, causing unwanted oxygen to appear in the chlorine product stream recovered from the cell.

A second and preferred embodiment of the present invention is to operate the cell in a manner which acts to increase the backmigration of hydroxyl ions through the membrane to a degree sufficient to keep the pH at the desired level.

It has been found that this can be done, even with the aforesaid high performance membrane, if a slight modification is made in the way cell startup is performed. In many membrane cells, startup is normally performed with a caustic solution having between about a 32% to about a 35% concentration in the catholyte compartment. Under such conditions, the membrane is conditioned to allow relatively few hydroxyl ions to backmigrate into the anolyte compartment and current efficiency is maximized. As noted hereinabove, with relatively few hydroxyl ions appearing in the anolyte compartment, the aforesaid HCl and HOCl remain largely unneutralized with the discharged depleted brine reaching pH values in the range of about 2–3.

In the process of the present invention, such a situation is avoided by modifying the cell startup procedure to promote a sufficiently high level of hydroxyl ion backmigration to raise the pH of the depleted brine from the normal 2–3 level to the preferred level of about 3.5 and most preferably to about 4. This effect is accomplished by reducing the concentration of NaOH in the catholyte solution at startup and adjusting the catholyte flow conditions to allow it to slowly build up to the "normal" 32–40% caustic product concentration. In the process of the present invention, the startup caustic concentration is from about 26% to about 30% NaOH and preferably between about 27% to about 29% and the build up time is between about 15 to about 35 days and preferably from about 23 to about 30 days, all other cell operating parameters remaining the same.

When this is done, the anolyte pH is stabilized at this higher level, with very low levels of aluminum being deposited in the membrane and with substantially longer membrane life being achieved as compared to normal startup procedures.

Further, although the overall current efficiency at startup is lower than that observed with said normal procedure, such an effect disappears as the caustic concentration is built up in the catholyte compartment and, once maximized, the cell operating parameters tend to remain fairly constant during a prolonged period of cell operation. Contrarily, it is observed that the cell, in which a high concentration of caustic is used at startup, current efficiency, while higher at the start, declines and that the cell operating parameters vary erratically during prolonged operation.

Although the above-described cell operating procedure stabilizes any aluminum-silica colloidal particles present in the brine, the continuous addition of silica and aluminum to the brine by the aforementioned resaturation and brine treatment steps necessitates that an amount of aluminum and silica, more or less equal to the amounts added, be removed to prevent an unacceptable build up of these components within the circulating brine stream. Currently used brine reconditioning practices present several opportunities to do so. For example, to alleviate similar build up problems with sulfate and chlorate ions in the brine, a portion of the brine is routinely removed after dechlorination and discarded from the system. While the increases in these ions may not necessarily equal or surpass the aluminum-silica complex build up, such routine "purging" will significantly lower the complex level in the brine.

Another treatment frequently applied is the acidification of at least a portion of the depleted dechlorinated brine to a pH of less than about 2 as a means of decomposing the hypochlorite ion concentration therein. At this level, the complex dissociates to form ionic aluminum which may then be removed by conventional processes such as ion exchange. Further, hypochlorite decomposition may be abetted by the addition of an oxidizable material to the brine. In one such process, as defined in U.S. Pat. No. 4,404,465, issued to Moore and Dotson on Sept. 20, 1983, oxalic acid is added to the acidified brine. Where the removal of aluminum from the brine is desired as well, such a process could be adjusted to provide a controlled excess of oxalate ions to foster the formation and precipitation of aluminum oxalate therefrom prior to reconstituting the brine for reuse in the cell. Without the presence of aluminum to complex the silica, the calcium and magnesium in the rock salt used for resaturation can react with it to form insoluble silicates which can be removed along with other insolubles in the salt during subsequent treatment.

EXAMPLE 1

A prototype membrane electrolytic cell having about a 3.5 $m^2$ sulfonate/carbonate membrane therein was operated with a circulating sodium chloride brine as the anolyte feedstock. During operation, the depleted brine producing during electrolysis was recovered, dechlorinated and resaturated using standard procedures. It was then successively treated with excess concentrations of 1.0 gpl $Na_2CO_3$ and 0.5 gpl of NaOH to precipitate calcium, magnesium, and heavy metals such as iron. After settling for about 9 hours, the resaturated brine was finally conditioned for cell use by filtering it to a 1–3 micron nominal retention and passing it through a cation exchange bed of CR-10® resin at a pH of 8–10, a temperature of 60°–70° C. at a 40 bed volume/hour flow rate. This produced a brine having a calcium content of about 40 ppb, an aluminum content averaging about 1.5 ppm and a silica content averaging about 6 ppm. No other treatments were applied to remove aluminum or silica.

The cell was charged with a 28% NaOH catholyte solution which, after electrolysis was started, was slowly raised, over a period of 25 days to a concentration of 32%. By so doing, it was found that the pH of the discharged, depleted brine always remained above 4.0 at an operating temperature of 90° C.

Operating at a steady cell voltage of about 3.4, the current efficiency rose with increasing catholyte concentration from 90% to 95% after 30 days of operation while power consumption declined from 2500 to about 2400 KWH/ton of caustic at which levels they stayed for essentially the entire length of the run. The salt content in the depleted brine was constant at about 200 gpl.

After 101 days, cell operation was discontinued and the membrane removed. Visual inspection of the membrane after shut down showed no evidence of damage on the cathode side of the membrane. Acid extraction analysis showed the membrane had an aluminum content of 1.6 mg/dm$^2$. X-ray fluoroescence (XRF) results showed a major Si peak and minor peaks of Al, Si, Cl and Ca on the cathode side. Scanning Electron Micrographs (SEM) of the cathode surface of the membrane showed it to be relatively smooth.

COMPARATIVE EXAMPLE A

The run of Example 1 was repeated with the exceptions that the pH of the feedstock was lowered to a range of 2 to 3 by the addition of hydrochloric acid thereto after the final ion exchange treatment and a 32% NaOH catholyte solution was used from the start of electrolysis.

The cell was operated under these conditions for 64 days during which time the current efficiency declined from about 97% to about 92%, while the power consumption increased from 2500 to 2700 KWH/ton. During the run, the cell voltages varied irregularly between about 3.6 and 3.75.

At the conclusion of the run, the membrane was removed. Visual examination showed it to be distinctly "whiter" than was observed with the membrane of Example 1. Acid extraction analysis showed an aluminum content of 12 mg/dm$^2$ while XRF analysis showed major peaks for Al, Si and S and a minor Ca peak on the cathode side. An SEM inspection of the cathode surface showed it to be considerably rougher than the membrane in Example 1.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meshing and range of equivalency of the claims are therefore intended to be embraced therein.

What is claimed is:

1. A process for stabilizing a complex of metal and silica in an alkali metal halide brine used as an anolyte feedstock in an electrolytic membrane cell having an anolyte compartment and a catholyte compartment, said process comprising (a) adjusting the pH of said brine to a level of between about 4 and about 12; and (b) passing said pH adjusted brine into said anolyte compartment while operating said cell under conditions which maintain the pH of said brine during electrolysis at a value above about 3.5, said operating conditions comprising (i) initially charging said catholyte compartment with a caustic solution having an alkali metal hydroxide concentration of between about 26% to about 30% at the startup of said cell; and (ii) changing the concentration of the caustic solution in said catholyte compartment so that, over a period of from about 15 to about 35 days, said alkali metal hydroxide concentration builds up to between about 32% and about 40%.

2. The process of claim 1 wherein the pH of said brine during electrolysis is limited to a value no lower than about 4.

3. The process of claim 1 wherein said feedstock has a pH of between about 8 and about 10.

4. The process of claim 3 wherein said initial caustic charge has a concentration of between about 27% to about 29%.

5. The process of claim 3 wherein said build up period is from about 23 to about 30 days.

6. The process of claim 5 wherein said alkali metal halide is sodium chloride.

7. The process of claim 6 wherein said metal is aluminum.

8. The process of claim 1 wherein said pH adjustment comprises adding an amount of an alkali metal hydroxide to raise the pH of said brine.

9. The process of claim 1 wherein said process further comprises the steps of (a) recovering said brine from said cell;

(b) removing at least a portion of said complex from said brine;

(c) reconstituting said brine for reuse within said cell; and (d) returning to step (a) of claim 1.

10. A process for stabilizing a complex of aluminum and silica in a sodium chloride brine used as an anolyte feedstock in an electrolytic membrane cell having an anolyte compartment and a catholyte compartment, said process comprising (a) adjusting the pH of said brine to a level of between about 4 and about 12; and (b) passing said pH adjusted feedstock into said anolyte compartment while operating said cell under conditions which maintain the pH of said brine during electrolysis at a value above about 3.5, said operating conditions comprising (i) initially charging said catholyte compartment with a caustic solution having a sodium hydroxide concentration of between about 26% to about 30% at the startup of said cell; and (ii) changing the concentration of the caustic solution in said cell so that, over a period of from about 15 to about 35 days, said sodium hydroxide concentration builds up to between about 32% and about 40%.

11. A process for stabilizing a complex of metal and silica in an alkali metal halide brine used as an anolyte feedstock in an electrolytic membrane cell having an anolyte compartment and a catholyte compartment, said process comprising (a) adjusting the pH of said brine to a level of between about 4 and about 12; and (b) passing said pH adjusted brine into said anolyte compartment while operating said cell under conditions which maintain the pH of said brine during electrolysis at a value above about 3.5, said operating conditions comprising (i) initially charging said catholyte compartment with a caustic solution having an alkali metal hydroxide concentration of between about 26% to about 30% at the startup of said cell; and (ii) changing the concentration of the caustic solution in said catholyte compartment so that, over a period of from about 15 to about 35 days, said alkali metal hydroxide concentration builds up to between about 32% and about 40%;

(c) recovering said brine from said anolyte compartment;

(d) removing at least a portion of said complex from said brine;

(e) reconstituting said brine for reuse within said anolyte compartment; and (f) returning to step (a).

12. A process for stabilizing a complex of aluminum and silica in a sodium chloride brine used as an anolyte brine in an electrolytic membrane cell having an anolyte compartment and a catholyte compartment, said process comprising (a) adjusting the pH of said brine to a level of between about 4 and about 12;

(b) passing said pH adjusted brine into said anolyte compartment while operating said cell under conditions which maintain the pH of said brine during electrolysis at a value above about 3.5, said operating conditions comprising (i) initially charging said catholyte compartment with a caustic solution having a sodium hydroxide concentration of between about 26% to about 30% at the startup of said cell; and (ii) changing the concentration of the caustic solution in said catholyte compartment so that, over a period of from about 15 to about 35 days, said sodium hydroxide concentration builds up to between about 32% and about 40%;

(c) recovering said brine from said anolyte compartment;

(d) removing at least a portion of said complex from said brine;

(e) reconstituting said brine for reuse within said anolyte compartment; and (f) returning to step (a).

* * * * *